United States Patent [19]

Franklin, Jr.

[11] Patent Number: 4,502,293

[45] Date of Patent: Mar. 5, 1985

[54] CONTAINER $CO_2$ COOLING SYSTEM

[76] Inventor: Paul R. Franklin, Jr., P. O. Box 37978, Jacksonville, Fla. 32236

[21] Appl. No.: 589,697

[22] Filed: Mar. 13, 1984

[51] Int. Cl.[3] ..... F25D 3/12

[52] U.S. Cl. ..... 62/388; 62/407

[58] Field of Search ..... 62/384, 388, 406, 407, 62/419

[56] References Cited

U.S. PATENT DOCUMENTS

| | | | |
|---|---|---|---|
| 3,561,226 | 2/1971 | Rubin | 62/388 |
| 3,695,056 | 10/1972 | Glynn et al. | 62/384 |
| 3,866,435 | 2/1975 | Frank et al. | 62/388 |
| 4,299,429 | 11/1981 | Franklin, Jr. | 62/384 |
| 4,404,818 | 9/1983 | Franklin, Jr. | 62/384 |

*Primary Examiner*—Ronald C. Capossela
*Attorney, Agent, or Firm*—Harvey B. Jacobson; Clarence A. O'Brien

[57] ABSTRACT

A generally rectangular container is provided including insulated top, bottom, opposite side and opposite end walls. An upstanding transverse insulated hollow housing is mounted within the container adjacent one end thereof and a $CO_2$ snow cabinet constructed of good heat transfer material is disposed within the housing with opposing wall portions of the cabinet and housing passing exteriorly about the cabinet. A heat insulative horizontal baffle is mounted within the container spaced below the top wall and extends between the sidewalls thereof. The baffle defines a cooled air passage beneath the top wall extending lengthwise of the container. The airflow passage includes an outlet end adjacent and in at least reasonably closed communication with the end of the cooled air passage adjacent the aforementioned one container end wall and an inlet end opening outwardly of the housing into the interior of the container below the baffle. The end of the cooled air passage adjacent the other container end wall opens into the interior of the container and thermostatically controllable air pump structure is provided to effect airflow inwardly of the inlet of the airflow passage, through the airflow passage and into the cooled air passage. Further, structure is provided for spray discharging of liquid $CO_2$ into the interior of the upper portion of the cabinet and into the airflow passage at points spaced therealong in order to form $CO_2$ snow therein.

10 Claims, 6 Drawing Figures

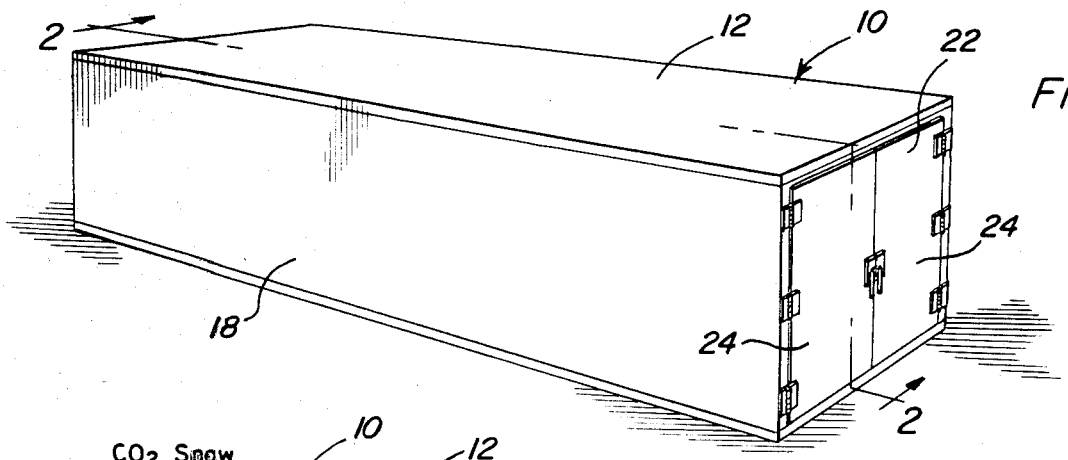
Fig. 1
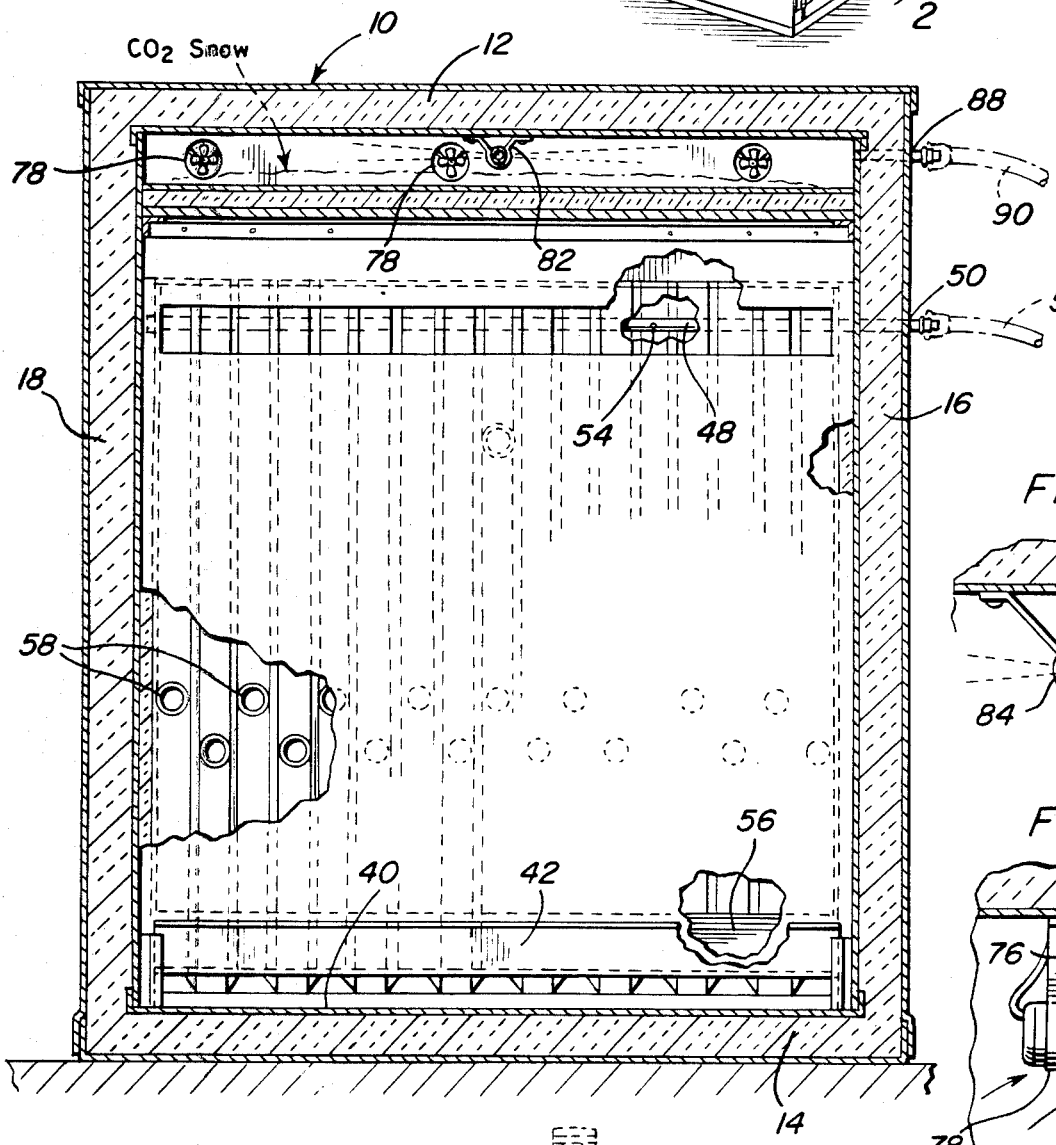
Fig. 3
Fig. 4
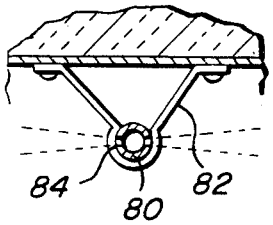
Fig. 5
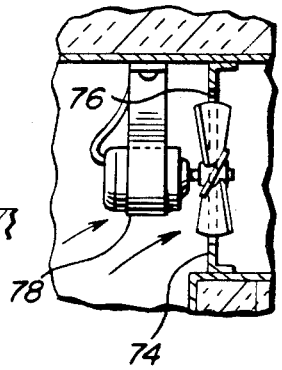
Fig. 6
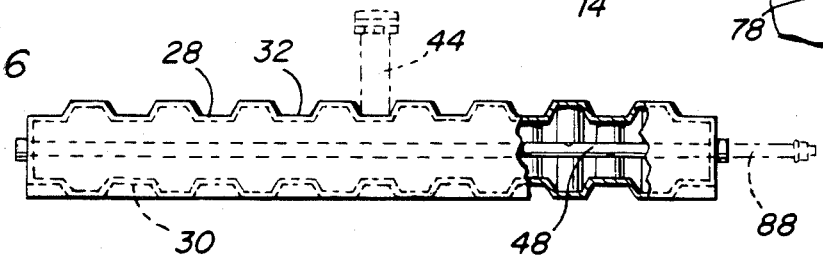

CONTAINER $CO_2$ COOLING SYSTEM

BACKGROUND OF THE INVENTION

Insulated containers such as semi-trailer bodies, railcars truck bodies and shipping containers are used to transport various perishables in refrigerated or frozen condition and most of these containers, when comprising a vehicle body portion, are equipped with mechanical refrigeration units to provide the desired cooling of the container interiors.

However, mechanical refrigeration units are subject to failure and shipping containers transported by ship or rail cannot be conveniently and economically mechanically refrigerated. Accordingly, a recent trend has developed in the refrigerated container field to utilize liquid $CO_2$ as a means of maintaining the interiors of refrigerated containers at the desired temperatures.

When $CO_2$ is used in this manner a tank is conventionally provided within the container to be chilled and liquid $CO_2$ is sprayed into the tank in order to form $CO_2$ snow therein. The tank is usually vented to the exterior of the associated container and constructed of good heat transfer materials, whereby the atmosphere within the container may be passed in good heat transfer relation with the external surfaces of the tank in order to achieve the desired cooling effect whenever the temperature within the container rises above a predetermined high temperature. This type of refrigeration has proven to be adequate, inexpensive, trouble free and reliable. However, in some instances wherein a $CO_2$ cooled container is to be maintained chilled over extended periods of time and therefore must be provided with a reasonably large quantity of $CO_2$ snow in order to provide the desired cooling over that extended period of time, the cooling effect of the large quantity of $CO_2$ snow within the container, even independent of mechanically assisted airflow over the outer surfaces of the $CO_2$ tank, causes the temperature within the container to drop below the desired minimum temperature within the container. This causes produce which is being shipped to become frozen and spoiled. Accordingly, a need exists whereby reasonably large quantities of $CO_2$ snow contained within a refrigerated container may be prevented from excessively cooling the interior of the container. Still further, a need also exists for the same container to also be usuable in transporting frozen foodstuffs.

BRIEF DESCRIPTION OF THE INVENTION

The container of the instant invention comprises a generally elongated rectangular insulated container having an insulated housing mounted therewithin adjacent one end of the container. The housing encloses a $CO_2$ snow tank and defines an airflow passage within the housing about the tank. The inlet end of the airflow passage opens into the interior of the container exteriorly of the housing and a full width transverse insulated partition is mounted within the container spaced below the top wall thereof and extends longitudinally of the container and defines a cooled air passage between the partition and the container top wall. The outlet end of the outlet passage opens into the adjacent end of the cooled air passage and the opposite end of the cooled air passage opens into the end of the interior of the container remote from the housing. Thermostatically controllable air pump structure is provided and is operative to cause air to flow from the interior of the container, through the airflow passage and the cooled air passage and back into the interior of the container at the end thereof remote from the housing. In this manner, the interior of the container may be maintained at a desired low temperature without the temperature within the container dropping below a predetermined minimum temperature.

If the container is to be used to transport produce which is not to be frozen, the insulation of the housing and the partition becomes extremely important in order to prevent the produce from being frozen. If, on the other hand, frozen materials are to be transported in the container, the air pump structure provided for pumping the atmosphere within the container over the cooled exterior surfaces of the $CO_2$ snow tank is sufficient to provide the cooling to maintain freezing temperatures.

The main object of this invention is to provide a $CO_2$ refrigerated container which may be utilized for transporting produce which is not to be frozen as well as frozen materials.

Another object of this invention is to provide a $CO_2$ refrigerated container constructed in a manner whereby its usage in transporting produce or frozen foodstuffs may be extended over long periods of time.

Yet another object of this invention is to provide a $CO_2$ snow cooled container which may be used for transporting refrigerated as well as frozen produce over less than maximum time periods independent a $CO_2$ atmosphere within the container.

A final object of this invention to be specifically enumerated herein is to provide a container $CO_2$ system which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a container constructed in accordance with the present invention;

FIG. 3 is a transverse vertical sectional view taken substantially upon the plane indicated by the section line 3—3 of FIG. 2 and with various portions of the container cooling structure being broken away to expose otherwise hidden components;

FIG. 4 is an enlarged fragmentary transverse vertical sectional view illustrating the manner in which the liquid $CO_2$ delivery pipe within the upper portion of the container is supported from the underside of the top wall thereof;

FIG. 5 is a fragmentary enlarged vertical section view illustrating one of the fan assemblies of the container; and FIG. 6 is a top plan view of the $CO_2$ tank of the container with portions of the upper tank being broken away and illustrated in horizontal section.

DETAILED DESCRIPTION OF THE INVENTION

Figure 2:
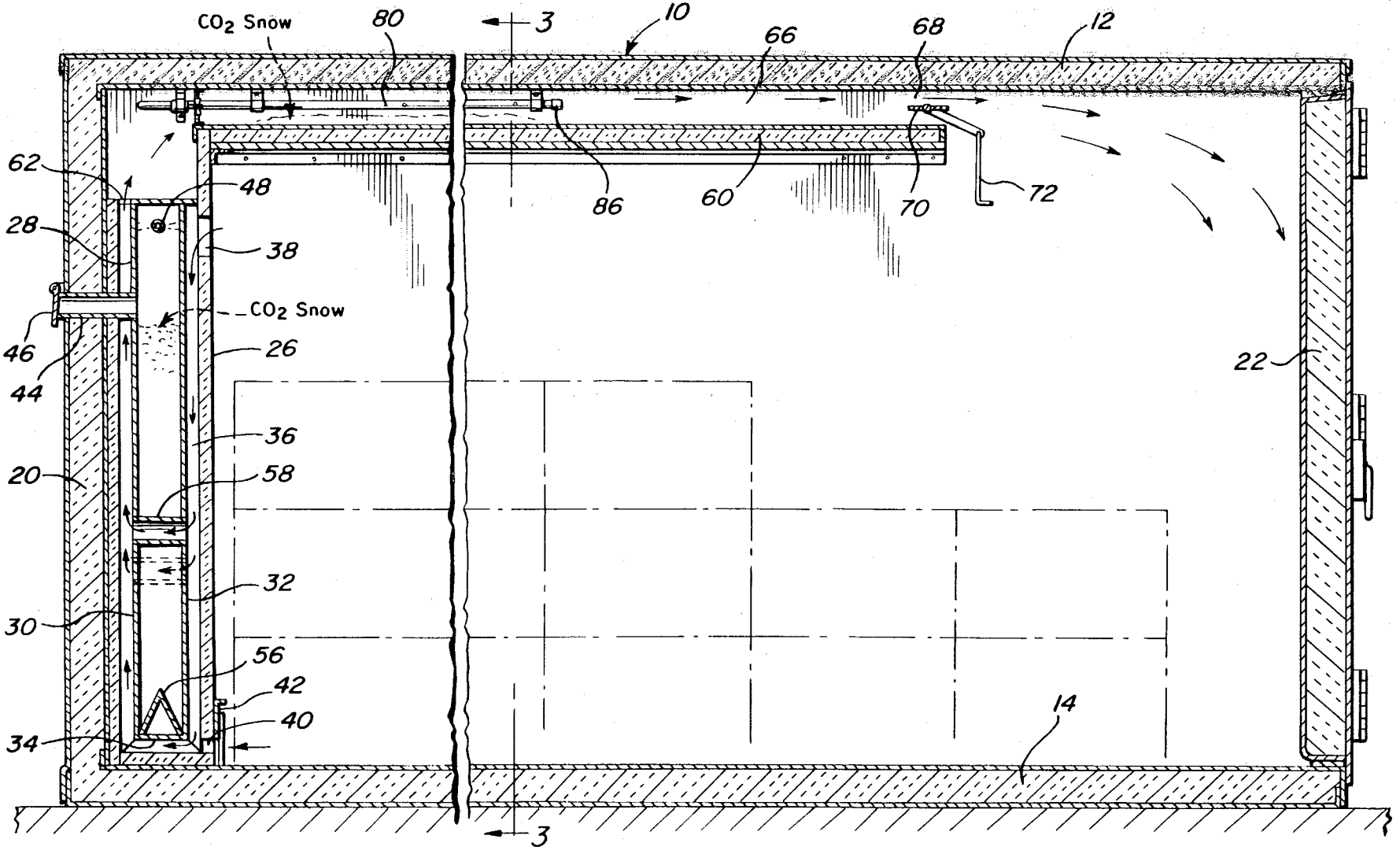
FIG. 2 is a fragmentary enlarged longitudinal vertical sectional view taken substantially upon the plane indicated by the section line 2—2 of FIG. 1.

Referring now more specifically to the drawings, the numeral 10 generally designates the container of the instant invention. The container 10 may comprise a semi-trailer body, a railway car body or an independent container which may be shipped on a rail flat car or boat.

The container 10 includes insulated top and bottom walls 12 and 14, insulated opposite sidewalls 16 and 18 and insulated front and rear walls 20 and 22. The rear wall 22 actually comprises a pair of horizontally swingable rear access doors 24.

An open top insulated housing 26 is mounted within and extends transversely of the front end of the container 10 and houses a $CO_2$ tank 28 including corrugated front and rear walls 30 and 32 as well as a corrugated bottom wall 34. The corrugations of the tank 28 define an airflow passage 36 within the housing 26 about the tank 28 and the airflow passage 36 includes a first upper air inlet 38 comprising an opening formed in an upper portion of the rear wall of the housing and a second air inlet 40 comprising an outlet formed in a lower marginal portion of the rear wall of the housing 26. In addition, the second inlet 40 has a slidable damper plate 42 operatively associated therewith whereby the second inlet 40 may be closed.

The interior of the tank 28 is vented through the front wall 20 of the container 10 via a vent pipe 44 equipped with a pivoted flap valve 46 on its outer end and the upper portion of the interior of the tank 28 includes a liquid $CO_2$ delivery and spary pipe 48 supported therein. One end of the spray pipe 48 is closed and the other inlet end thereof opens outwardly of the sidewall 16 of the container 10 as at 50 and may have the outlet end of a liquid $CO_2$ line 52 operatively connected therewith. When liquid $CO_2$ is supplied to the pipe 48 from the line 52 and discharged through longitudinally spaced lateral outlets 54 formed in the pipe 48 $CO_2$ snow is formed within the upper portion of the interior of the tank 28 and falls downwardly toward the bottom of tank 10. The lower portion of the interior of the tank 10 includes a snow splitter shield 56 by which the $CO_2$ snow within the tank 28 is split and urged into tight heat transfer engagement with the inner surfaces of the lower marginal portions of the front and rear walls of the tank 28. In addition, intermediate height portions of the front and rear walls of the tank 28 have the front and rear ends of a plurality of transverse air passage tubes 58 sealingly secured therethrough whereby the tubes 58 also comprise portions of the airflow passage 36.

The interior of the container 10 includes an upper horizontal transverse baffle or partition 60 which is heavily insulated. The partition 60 is spaced slightly below the top wall 12 and extends between the sidewalls 16 and 18 and longitudinally of the container 10. The passage 36 includes an outlet end 62 which opens upwardly toward the top wall 12 and the front marginal portion of the partition 60 is sealed relative to the upper marginal edge of the rear wall of the housing 26. Thus, the outlet end of the airflow passage is direct sealed communication with the inlet end of the cooled air passage 66 defined between the partition 60 and the underside of the top wall 12, the cooled air passage 66 including an outlet end 68 which opens rearwardly into the rear upper portion of the interior of the container 10. The outlet end 68 of the cooled air passage 66 is equipped with a full width oscillatable damper 70 having a control member 72 operatively connected thereto for manual shifting of the damper 70 from the open position thereof illustrated in FIG. 2 to a closed position substantially closing the outlet end 68 of the cooled air passage 66. The control member 72 may be either manually operated or remotely or automatically operated.

The inlet end of the cooled air passage 66 includes a partition 74 extending thereacross including three openings 76 formed therethrough and electrically powered blower assemblies 78 are mounted in operative association with the openings 76 whereby operation of the blower assemblies 78 will cause air from within the forward portion of the interior of the container 12 to be drawn inwardly into the airflow passage 36, from the latter into the cooled air passage 66 and thereafter outwardly of the cooled air passage back into the upper rear portion of the interior of the container 12.

The cooled air passage 66 includes a longitudinally extending pipe 80 supported therein from the top wall 12 by suitable brackets 82 and the pipe 80 is similar to the pipe 48 and includes longitudinally spaced oppositely outwardly directed spray jet openings 84. One end of the pipe 80 is closed by an end cap 86 and the other end thereof opens outwardly through the sidewalls 16 of the container 12 as at 88 and may have the discharge end of a $CO_2$ line 90 operatively connected thereto. By discharging liquid $CO_2$ from the pipe 80 in opposite directions at points spaced longitudinally of the cooled air passage 66 additional quantities of $CO_2$ snow may be formed within the cooled air passage 66.

In operation, and assuming that the container is to be used over an extended period of time, for transport of produce, $CO_2$ snow may be formed and received in the tank 28 and the cooled air passage 66. The damper 70 may be closed and the mere presence of a large quantity of $CO_2$ snow within the tank 28 and the cooled air passage 66 will maintain the interior of the container 10 at cooled temperatures above the freezing point, the damper 70 being closed in order to prevent excessive cooling of the interior of the container 10. It is also to be noted that the damper 70 may be insulated, if desired, in order to further insure that the interior of the container 10 will not drop in temperature to the freezing point when produce is being transported within the container 10. Some cooling of the interior of the container may be accomplished by convection airflow through that portion of the passage 36 extending between the inlets 38 and 40 when the damper plate 42 is open. However, if the ambient temperature is not excessively high, the damper plate 42 may be closed to terminate such convection airflow and the interior of the container 10 will be maintained in a cooled condition merely by inherent heat transfer from the load therewithin to the $CO_2$ snow within the tank 28 and the cooled air passage 66 through the various associated insulated portions of the apparatus separating the interior of the container 10 from the $CO_2$ snow containing areas.

Upon the depletion of $CO_2$ snow to at least some reasonable extent, the plate 42 may be raised to allow at least some convection currents to provide the necessary chilling and if the interior of the container 10 is to be maintained below freezing, the fans or pump assemblies 78 may be actuated and the damper 70 may be opened. In any event, the container 10, once provided with ample supplies of $CO_2$ snow, is operative to maintain the temperatures therewithin slightly above freezing for produce and well below freezing for frozen goods over extended periods of time.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A $CO_2$ cooled container including interconnected insulated top and bottom walls, opposite side walls and opposite end walls, an upstanding transverse insulated hollow housing mounted within said container adjacent one end wall thereof, a $CO_2$ snow cabinet disposed within said housing constructed of good heat transfer material and with opposing wall portions of said cabinet and housing in laterally spaced relation to define an airflow passage within said housing passing exteriorly about said cabinet, a heat insulative horizontal baffle mounted within said container spaced below said top wall and extending between said sidewalls, said baffle defining a cooled air passage beneath said top wall extending lengthwise of said container, said airflow passage including an outlet end adjacent and in at least reasonably closed communication with the end of said cooled air passage adjacent said one end wall and an inlet end opening outwardly of said housing into the interior of said container adjacent the end thereof remote from said housing, thermostatically controllable air pump means operative to effect airflow inwardly of said inlet, through said airflow passage and into the end of said cooled air passage adjacent said one end wall, and means operative to admit liquid $CO_2$ into the interior of the upper portion of said cabinet and to thereby form $CO_2$ snow therein.

2. The container of claim 1 including means for spray admitting liquid $CO_2$ into the interior of said cooled air passage at points spaced along to thereby form additional $CO_2$ snow therein.

3. The container of claim 2 including means operative to adjustably close the end of said cooled air passage remote from said one end wall.

4. The container of claim 1 wherein said airflow passage includes means for supporting convection flow of air within the interior of said container through at least a portion of said airflow passage.

5. The container of claim 4 wherein said means for supporting convection airflow through said airflow passage includes means for adjustably blocking convection airflow therethrough.

6. The container of claim 1 including means for spray admitting liquid $CO_2$ into the interior of said cooled air passage at points spaced along to thereby form additional $CO_2$ snow therein, means operative to adjustably close the end of said cooled air passage remote from said one end wall, said airflow passage including means for supporting convection flow of air within the interior of said container through at least a portion of said airflow passage.

7. The container of claim 6 wherein said means for supporting convection airflow through said airflow passage includes means for adjustably blocking convection airflow therethrough.

8. The container of claim 1 wherein said airflow passage includes parallel reaches thereof disposed on opposite sides of said tank through which said air pump means is operative to effect airflow therethrough in opposite directions, said tank including heat conductive airflow passage defining tubular members extending therethrough with the opposite ends thereof opening into said parallel reaches.

9. The container of claim 8 wherein said airflow passage includes means for supporting convection flow of air within the interior of said container through at least a portion of said airflow passage.

10. The container of claim 9 wherein said means for supporting convection airflow through said airflow passage includes means for adjustably blocking convection airflow therethrough.

* * * * *